US012286875B2

(12) United States Patent
Hatten et al.

(10) Patent No.: US 12,286,875 B2
(45) Date of Patent: Apr. 29, 2025

(54) SYSTEM AND METHOD OF USING A THERMOPLASTIC CASING IN A WELLBORE

(71) Applicant: Ur-Energy USA Inc., Littleton, CO (US)

(72) Inventors: Steven M. Hatten, Casper, WY (US); John W. Cash, Casper, WY (US)

(73) Assignee: Ur-Energy USA Inc., Littleton, CO (US)

( * ) Notice: Subject to any disclaimer, the term of this patent is extended or adjusted under 35 U.S.C. 154(b) by 0 days.

(21) Appl. No.: 18/115,387

(22) Filed: Feb. 28, 2023

(65) Prior Publication Data

US 2023/0272702 A1 Aug. 31, 2023

Related U.S. Application Data

(60) Provisional application No. 63/314,778, filed on Feb. 28, 2022.

(51) Int. Cl.
*E21B 43/28* (2006.01)
*E21B 17/10* (2006.01)
(Continued)

(52) U.S. Cl.
CPC ..... *E21B 43/28* (2013.01); *E21B 17/1078* (2013.01); *E21B 29/002* (2013.01);
(Continued)

(58) Field of Classification Search
CPC ..... E21B 43/28; E21B 43/04; E21B 43/08; E21B 43/10; E21B 17/1078;
(Continued)

(56) References Cited

U.S. PATENT DOCUMENTS 3,277,962 A * 10/1966 Flickinger ..... E21B 43/045 166/278
5,462,120 A * 10/1995 Gondouin ..... E21B 7/061 166/380

(Continued)

FOREIGN PATENT DOCUMENTS

KR 10-1994335 6/2019

OTHER PUBLICATIONS

"Engineering Info for HDPE Pipe," WL Plastics, Jul. 24, 2021, retrieved from https://web.archive.org/web/20210724140728/https://wlplastics.com/documents/engineering-info/, 2 pages.

(Continued)

*Primary Examiner* — Yong-Suk (Philip) Ro
(74) *Attorney, Agent, or Firm* — Sheridan Ross P.C.

(57) ABSTRACT

Systems and methods for using a continuous, thermoplastic tubing as a casing in a wellbore are provided. A continuous, thermoplastic tubing can be a high density polyethylene (HDPE) material that is stored in a coiled manner on a spindle. A screen can be attached to an end of the casing, and a tremie line can be selectively connected to the screen to inject gravel and cement downhole to pack the screen in place and grout the casing in place in the wellbore. The use of a continuous, thermoplastic tubing removes joints from the casing to improve performance, and such tubing is more readily available and cheaper than alternatives among other benefits described herein.

14 Claims, 7 Drawing Sheets

(51) Int. Cl.

| | |
|---|---|
| ***E21B 29/00*** | (2006.01) |
| ***E21B 33/14*** | (2006.01) |
| ***E21B 43/04*** | (2006.01) |
| ***E21B 43/08*** | (2006.01) |
| ***E21B 43/10*** | (2006.01) |
| *E21B 7/28* | (2006.01) |

(52) U.S. Cl.
CPC ..... *E21B 33/14* (2013.01); *E21B 43/04* (2013.01); *E21B 43/08* (2013.01); *E21B 43/10* (2013.01); *E21B 7/28* (2013.01)

(58) Field of Classification Search
CPC ..... E21B 29/002; E21B 33/14; E21B 33/13; E21B 17/20; E21B 7/02
See application file for complete search history.

(56) References Cited

U.S. PATENT DOCUMENTS

| | | | | |
|---|---|---|---|---|
| 6,497,290 | B1 * | 12/2002 | Misselbrook | E21B 49/08 166/77.2 |
| 8,708,422 | B1 | 4/2014 | Krumhansl et al. | |
| 2003/0075361 | A1 * | 4/2003 | Terry | E21B 17/206 175/171 |
| 2006/0076133 | A1 * | 4/2006 | Penno | E21B 43/045 166/278 |
| 2014/0076580 | A1 * | 3/2014 | Holderman | E21B 43/04 166/278 |
| 2020/0088447 | A1 | 3/2020 | Reitsma | |

OTHER PUBLICATIONS

"The Voice of an Industry," Plastic Pipe Institute, Sep. 9, 2021, retrieved from https://web.archive.org/web/20210909031856/https://www.plasticpipe.org//, 4 pages.
ASTM F480, "Standard specification for Thermoplastic Well Casing Pipe and Couplings Made in Standard Dimension Ratios (SDR), SCH 40 and SCH 80," 2014, 11 pages.
ASTM, Designation: D256—10, "Standard Test Methods for Determining the Izod Pendulum Impact Resistance of Plastics," 2015, 10 pages.
ASTM, Designation: D 746—98, "Standard Test Method for Brittleness Temperature of Plastics and Elastomers by Impact," Apr. 2002, 4 pages.
Lost Creek NRC Environmental Report, "Lost Creek ISR, LLC, Lost Creek Project, South-Central Wyoming," Oct. 2007, 783 pages, (uploaded in 9 parts).
Lost Creek NRC Tech Report, "Submittal of License Application for the Lost Creek ISR Project," Oct. 30, 2007, 557 pages, (uploaded in 10 parts).
Lost Creek Project, WDEQ-LQD Permit to Mine Application, Sep. 29, 2010, 86 pages.
LQD Guideline 4, Reference Doc. 8, Section -I(c)(1), "Well Installation Completion," Revision Date: Oct. 28, 2013, 179 pages.
Nuclear Regulatory Commission (NRC) NUREG 1569, Standard Review Plan for In Situ Leach Uranium Extraction License Application, Final Report, Jun. 2003, 255 pages.
Nuclear Regulatory Commission (NRC) NUREG 1910 Supplement 3, "Environmental Impact Statement for the Lost Creek ISR Project in Sweetwater County, Wyoming, Supplement to the Generic Environmental Impact Statement for In-Situ Leach Uranium Milling Facilities," Final Report, Jun. 2011, 735 pages, (uploaded in 5 parts).
Nuclear Regulatory Commission (NRC) NUREG 1910, "Generic Environmental Impact Statement for In-Situ Leach Uranium Milling Facilities, Chapters 1 through 4," Final Report, May 2009, 1303 pages, (uploaded in 7 parts).
Nuclear Regulatory Commission, "Safety Evaluation Report for the Lost Creek Project, Sweetwater County, Wyoming, Materials License No. SUA-1598," Docket 40-9068, Aug. 2011, 255 pages, (uploaded in 2 parts).
Plastic Pipe Institute, Design-Chapter 3, Material Properties, 2008, pp. 43-103.
Plastic Pipe Institute, Technical Report 19, Chemical Resistance of Plastic Piping Materials, Dec. 2020, 67 pages.
WQD, Chapter 12, "Design and Construction Standards for Public Water Supplies," Mar. 4, 2020, pp. 12-1 through 12-94.
WQD, Chapter 26, "Well Construction Standards," 2018, pp. 26-1 through 26-11.
Wyoming Environmental Quality Council, "New Uranium Recovery Rules and Regulations, Chapters 1 through 10," Jan. 2016, 138 pages.
Wyoming Environmental Quality Council, "Non Coal Rules and Regulations, Chapter 11 In Situ Mining," Section 8, Well Construction Requirements, Sep. 25, 2018, 178 pages.
International Search Report and Written Opinion for International (PCT) Patent Application No. PCT/US2023/014083, dated Jul. 27, 2023 21 pages.

* cited by examiner

SYSTEM AND METHOD OF USING A THERMOPLASTIC CASING IN A WELLBORE

CROSS REFERENCE TO RELATED APPLICATION

This application claims priority under 35 U.S.C. § 119(e) to U.S. Provisional Patent Application Ser. No. 63/314,778 filed Feb. 28, 2022, which is incorporated herein in its entirety by reference.

FIELD

The present disclosure relates generally to systems and methods for using a continuous, thermoplastic material as a casing in a wellbore. The thermoplastic material can be, for example, high density polyethylene (HDPE) that is stored in a coil or spool.

BACKGROUND

Casing a wellbore occurs after the wellbore is initially drilled, and casing the wellbore helps stabilize the well, keep contaminants and water out of the injection stream, and keep the injection stream from contaminating the groundwater outside of the well. In some wellbores, steel pipes are used as the casing material in deep wells and/or wells with extreme pressures. However, steel pipes are expensive and take a lot of time to assemble and deploy into a wellbore. In other wellbores, the casing material is polyvinyl chloride (PVC), which is ordinarily inexpensive and does not oxidize or rust like steel pipes. However, PVC casings also have several shortcomings.

One shortcoming of existing PVC casings is that PVC casings have multiple joints that can leak. PVC casings are assembled from multiple PVC pipes that are joined together with, for instance, spline-lock joints. Movements within the wellbore, changes in pressure, and many other events can damage these joints and cause a leak into or out of the casing, resulting in contamination of the injection stream, the surrounding groundwater, or both.

Another shortcoming of PVC casings is the relative expense and the intermittent availability of PVC casings. Recently, global supply disruptions, inflation, and hurricanes in the Gulf Coast region of the U.S. have resulted in a severe shortage of PVC casing materials in the U.S. as well as dramatically higher prices. Thus, subject to periodic or relatively common events, it may not be possible to acquire PVC casing materials in a timely manner or at reasonable prices for a normal drilling program. Therefore, there is a need for a casing that reduces the likelihood of leaks, that is cheaper, and that is more readily available than currently used casing materials.

SUMMARY

One aspect of the present disclosure is to provide a system and method for using a continuous tubing made from a thermoplastic material as a casing. The thermoplastic material can be, for example, high density polyethylene (HDPE) that is cheaper and more readily available than polyvinyl chloride (PVC). However, it will be appreciated that, in some embodiments, the casing material can be made from any thermoplastic material including, for example, any density of polyethylene (PE), including high or low density, polyvinyl chloride (PVC), polypropylene (PP), polyvinylidene fluoride (PVDF), thermoplastic elastomer (TPE), Tygon®, Nylon, polytetrafluoroethylene (PTFE), or polyurethane. In addition, the casing is made from a continuous tubing that does not have joints and can be stored in a coiled manner for deployment into a wellbore. Alternatively, as described herein, some embodiments may include a casing that has one or more segments joined together.

Another aspect of the present disclosure is to provide a continuous thermoplastic casing with a smaller diameter than currently used PVC casings to incur environmental and economic benefits. The continuous nature of the casing allows for a smaller diameter of the casing and a smaller initial borehole diameter for a drill, which in turn means smaller mud pits, less drill water consumption, less cement used, less casing material, less costs, etc. A smaller initial borehole diameter also reduces the likelihood of the "fall back" of cement in the annulus between the casing and the wellbore. This smaller diameter of the casing is expressed in absolute and relative terms in detail below.

A further aspect of the present disclosure is to provide a bottom completion method with the continuous thermoplastic casing. Current completion methods used for existing PVC casings are known as top completion methods where the completion zone of the wellbore is cemented with the PVC casing, then drilled out. This introduces the possibility of cement infiltrating and contaminating the completion zone. This completion method also necessitates an under-reaming procedure that can damage the casing. In contrast, a bottom completion method does not require drilling out cement in the completion zone, and thus, the bottom completion method does not introduce cement infiltration or contamination. In addition, with a bottom completion method, any under-reaming is optional and does not impact the casing itself.

Another aspect of the present disclosure is to provide an array of injection wells and production wells to stimulate a well and retrieve resources such as oil, gas, metal ore, and/or other materials in an environmentally sound and more cost effective manner. A fluid or lixiviant can be injected through the injection well into a geologic formation that contains natural resources like metal ore, and the lixiviant can dissolve or leach a desired metal ore. Then, the lixiviant can be retrieved through a production well, and the lixiviant is further processed to extract the desired metal ore. In some embodiments, the desired metal ore is uranium.

Other benefits of embodiments of the present disclosure include reduced drill rig time and material costs. Current techniques require 3.5 rig days to install a single well. Embodiments of the present disclosure can reduce that time to one rig day plus 0.5 man-days to complete the well or as much as a 75% reduction in drill rig time. This reduces time requirements, reduces costs, and reduces reliance on drilling contractors. The casing cost is also reduced by as much as 85%, and the overall cost reduction to install an injection well is estimated to be between $2.50 and $3.50 per pound of $U_3O_8$ produced. This represents as much as a 49% savings on the installation of an injection well. Injection wells generally represent approximately 65% of wells in wellfields designed with traditional "five-spot" or gridlike recovery patterns. Further benefits include reduced heavy vehicle traffic, up to 85% fewer air emissions during installation of injection wells, less noise, lower failure rate of the casing, less exposure of the casing to the drill string and drill bit, and mechanical integrity tests can be performed during installation without the need to reenter the well. In addition, embodiments of the present disclosure can comply with regulatory and safety standards.

It is another aspect of embodiments of the present disclosure to provide a tremie line with the continuous thermoplastic casing to supply gravel and cement into the wellbore. The tremie line can be affixed to a screen or even the casing as the casing and the screen are lowered into the wellbore. Gravel is supplied through the tremie line to surround the screen at the desired geologic formation. Then, as the tremie line is retrieved through the annular space between the casing and the wellbore, cement is deposited through the tremie line to complete the well and secure the casing. This method is different than the current technique which introduces the annular sealing material via the casing (displacement method). The tremie method will not require the well to be shut-in since there is no pathway for the cement to migrate up the casing. Cement is deposited into the annulus until there are returns to the surface. If there is "fall-back" of the cement greater than 40 feet (12.2 meters), the tremie line is placed back into the well as far as possible and additional cement is added. In addition to gravel and cement, the tremie line can also deposit, for example, bentonite clay mixtures into the annular space between the casing and the wellbore.

It is a further aspect of embodiments of the present disclosure to provide a casing and/or a tremie line made of a jointed tubing. In some embodiments, the casing and/or tremie line is made of a plurality of small diameter sticks of pipe composed of materials such as poly vinyl chloride or fiberglass. The pressure rating and chemical compatibility of small diameter pipe is acceptable in many applications related to in situ recovery of minerals and provides some of the benefits of coiled tubing. Thus, in one exemplary application, a production well has a casing made from a continuous, non-jointed tubing, and an injection well has a casing made from a plurality of small diameter sticks of pipe composed of materials such as PVC or fiberglass, or vice versa. In a further exemplary application, both of the injection well and the production well have a casing made from a plurality of small diameter sticks of pipe composed of materials such as PVC or fiberglass.

Embodiments of the present disclosure are described with respect to metal ore and uranium ore, but embodiments of the present disclosure are applicable to other materials. Embodiments of the present disclosure are applicable across the in-situ recovery industry including in recovery of copper, lithium, soda ash, potash and other soluble minerals. Moreover, embodiments of the present disclosure are applicable in the groundwater restoration industry when treated water is re-injected into the host aquifer. Further still, embodiments of the present disclosure provide cost benefits when micro-purging of groundwater monitor wells is desirable.

A first aspect of the present disclosure is to provide a method of installing a casing composed of a continuous, non-jointed, thermoplastic tubing in a wellbore, comprising: (i) providing a coil of the tubing; (ii) attaching a screen to an end of the tubing; (iii) uncoiling the tubing and lowering the tubing and a tremie line into the wellbore until the screen reaches a predetermined depth; (iv) raising the tubing and the tremie line by a predetermined distance to straighten and centralize the tubing within the wellbore; (v) injecting gravel through the tremie line to surround the screen with gravel as the tremie line is retrieved from the wellbore; (vi) injecting cement through the tremie line to fill an annular space between the tubing and the wellbore as the tremie line is further retrieved from the wellbore; and (vii) removing the tremie line from the wellbore and cutting the tubing leaving the casing without joints from a surface of the wellbore to the screen.

The method of the first aspect may, optionally, further comprise selectively connecting the tremie line to the screen prior to lowering the tubing and the tremie line into the wellbore, wherein the selective connection between the tremie line and the screen is offset from a lower end of the screen by between 1 foot and 3 feet.

The method of the first aspect may include one or more of the previous embodiments and, optionally, the tremie line is a continuous, non-jointed, thermoplastic tubing.

The method of the first aspect may include one or more of the previous embodiments and, optionally, further comprise sealing the end of the tubing and introducing a fluid into an interior volume of the tubing to increase a pressure required to collapse the tubing during injection of cement into the annular space.

The method of the first aspect may include one or more of the previous embodiments and, optionally, further comprise drilling the wellbore, wherein the inner diameter of the wellbore is between 150% and 300% of the outer diameter of the casing.

The method of the first aspect may include one or more of the previous embodiments and, optionally, an outer diameter of the tremie line is between 30% and 110% of the outer diameter of the casing.

The method of the first aspect may include one or more of the previous embodiments and, optionally, further comprise depositing an impermeable layer through the tremie line between the gravel and the cement. In some embodiments, the impermeable layer comprises a cap of sand.

The method of the first aspect may include one or more of the previous embodiments and, optionally, further comprise attaching a plurality of centralizers to the tubing as the tubing and the tremie line are lowered into the wellbore, wherein one centralizer of the plurality of centralizers is offset from the screen by approximately 2 feet, and wherein two centralizers of the plurality of centralizers are offset from each other by approximately 40 feet.

The method of the first aspect may include one or more of the previous embodiments and, optionally, further comprise under-reaming a portion of the wellbore at the predetermined depth.

The method of the first aspect may include one or more of the previous embodiments and, optionally, that the tubing is made from one of polyethylene (PE), polyvinyl chloride (PVC), polypropylene (PP), polyvinylidene fluoride (PVDF), thermoplastic elastomer (TPE), Tygon®, Nylon, polytetrafluoroethylene (PTFE), or polyurethane.

A second aspect of the present disclosure is to provide a system for using a continuous, non-jointed thermoplastic casing in a wellbore, comprising: a screen connected to an end of the casing, wherein the casing is stored in a coil; a tremie line is selectively connected to the screen at a location above a lower end of the screen; wherein, in a first mode of operation, the casing is uncoiled and the casing and the tremie line are lowered into the wellbore until the screen reaches a geologic formation, wherein the wellbore has an inner diameter that is larger than an outer diameter of the casing to allow for the tremie line to provide a grout or cement seal; and wherein, in a second mode of operation, the tremie line is disconnected from the screen, and at least one of gravel or cement flows through the tremie line to pack the screen and grout the casing as the tremie line is removed from the wellbore.

The system of the second aspect may include, optionally, that the casing is made from one of polyethylene (PE), polyvinyl chloride (PVC), polypropylene (PP), polyvinylidene fluoride (PVDF), thermoplastic elastomer (TPE), Tygon®, Nylon, polytetrafluoroethylene (PTFE), or polyurethane.

The system of the second aspect may include one or more of the previous embodiments and, optionally, an outer diameter of the tremie line is between 30% and 110% of the outer diameter of the casing.

The system of the second aspect may include one or more of the previous embodiments and, optionally, the inner diameter of the wellbore is between 150% and 300% of the outer diameter of the casing.

The system of the second aspect may include one or more of the previous embodiments and, optionally, further comprising a plurality of centralizers attached to the casing, wherein a lowest centralizer of the plurality of centralizers is offset from the screen by approximately 2 feet, and wherein two centralizers of the plurality of centralizers are offset from each other by approximately 40 feet.

The system of the second aspect may include one or more of the previous embodiments and, optionally, the tremie line is a continuous, non-jointed, thermoplastic tubing.

A third aspect of the present disclosure is to provide a method of extracting an ore from a geologic formation, comprising: (i) lowering a casing and an injection screen which is connected to an end of the casing into a wellbore; (ii) sealing a distal end of the casing and pressurizing an interior volume of the casing with a fluid as the casing is cemented in place in the wellbore to form an injection well; (iii) providing a production well having a casing and a production screen engaged with the casing of the production well; (iv) injecting a lixiviant fluid into the injection well where the lixiviant fluid travels through the casing of the injection well, through the injection screen, and into the geologic formation; (v) receiving a combination of the lixiviant fluid and the ore from the geologic formation through the production screen of the production well; and (vi) drawing the combination of the lixiviant fluid and the ore through the casing of the production well and out of the production well.

The method of the third aspect may include, optionally, that the injection well is one of a plurality of injection wells arranged in a grid-like pattern with an injection well located at each intersection of grid lines of the grid-like pattern; and wherein the production well is located within grid lines of the grid-like pattern and is located between four injection wells of the plurality of injection wells.

The method of the third aspect may include one or more of the previous embodiments and, optionally, a diameter of the casing of the production well is greater than a diameter of the casing of the injection well.

The method of the third aspect may include one or more of the previous embodiments and, optionally, the injection well is one of a plurality of injection wells arranged in a hexagonal pattern with an injection well located at each corner of the hexagonal pattern; and wherein the production well is located within the hexagonal pattern and is located between six injection wells of the plurality of injection wells.

The method of the third aspect may include one or more of the previous embodiments and, optionally, providing the injection well comprises uncoiling a continuous, non-jointed, thermoplastic tubing to serve as the casing of the injection well, and lowering the tubing and a tremie line into the wellbore until the screen reaches a predetermined depth; raising the tubing and the tremie line by a predetermined distance to straighten and centralize the tubing within the wellbore; injecting gravel through the tremie line to surround the injection screen with gravel as the tremie line is retrieved from the wellbore; injecting cement through the tremie line to fill an annular space between the tubing and the wellbore as the tremie line is further retrieved from the wellbore; and removing the tremie line from the wellbore and cutting the tubing leaving the casing without joints from a surface of the wellbore to the injection screen.

The method of the third aspect may include one or more of the previous embodiments and, optionally, further comprise drilling a wellbore, wherein an inner diameter of the wellbore of the injection well is between 150% and 300% of an outer diameter of the casing of the injection well.

The method of the third aspect may include one or more of the previous embodiments and, optionally, an outer diameter of the tremie line is between 30% and 110% of the outer diameter of the casing.

The method of the third aspect may include one or more of the previous embodiments and, optionally, the casing of the injection well and the casing of the production well are each made from one of polyethylene (PE), polyvinyl chloride (PVC), polypropylene (PP), polyvinylidene fluoride (PVDF), thermoplastic elastomer (TPE), Tygon®, Nylon, polytetrafluoroethylene (PTFE), or polyurethane.

The Summary is neither intended nor should it be construed as being representative of the full extent and scope of the present disclosure. The present disclosure is set forth in various levels of detail in the Summary as well as in the attached drawings and the Detailed Description and no limitation as to the scope of the present disclosure is intended by either the inclusion or non-inclusion of elements or components. Additional aspects of the present disclosure will become more readily apparent from the Detailed Description, particularly when taken together with the drawings.

The above-described embodiments, objectives, and configurations are neither complete nor exhaustive. As will be appreciated, other embodiments of the disclosure are possible using, alone or in combination, one or more of the features set forth above or described in detail below.

The phrases "at least one," "one or more," and "and/or," as used herein, are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B and C together.

The term "a" or "an" entity, as used herein, refers to one or more of that entity. As such, the terms "a" (or "an"), "one or more" and "at least one" can be used interchangeably herein.

Unless otherwise indicated, all numbers expressing quantities, dimensions, conditions, ratios, ranges, and so forth used in the specification and claims are to be understood as being modified in all instances by the term "about" or "approximately". Accordingly, unless otherwise indicated, all numbers expressing quantities, dimensions, conditions, ratios, angles, ranges, and so forth used in the specification and claims may be increased or decreased by approximately 5% to achieve satisfactory results. Additionally, where the meaning of the terms "about" or "approximately" as used herein would not otherwise be apparent to one of ordinary skill in the art, the terms "about" and "approximately" should be interpreted as meaning within plus or minus 10% of the stated value.

Unless otherwise indicated, the term "substantially" indicates a difference of from 0% to 5% of the stated value is acceptable.

All ranges described herein may be reduced to any sub-range or portion of the range, or to any value within the range without deviating from the invention. For example, the range "5 to 55" includes, but is not limited to, the sub-ranges "5 to 20" as well as "17 to 54."

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts and the equivalents thereof shall include all those described in the Summary, Brief Description of the Drawings, Detailed Description, Abstract, and Claims themselves.

BRIEF DESCRIPTION OF THE DRAWINGS

The accompanying drawings, which are incorporated in and constitute a part of the specification, illustrate embodiments of the disclosed system and together with the general description of the disclosure given above and the detailed description of the drawings given below, serve to explain the principles of the disclosed system(s) and device(s).

Figure 1A:
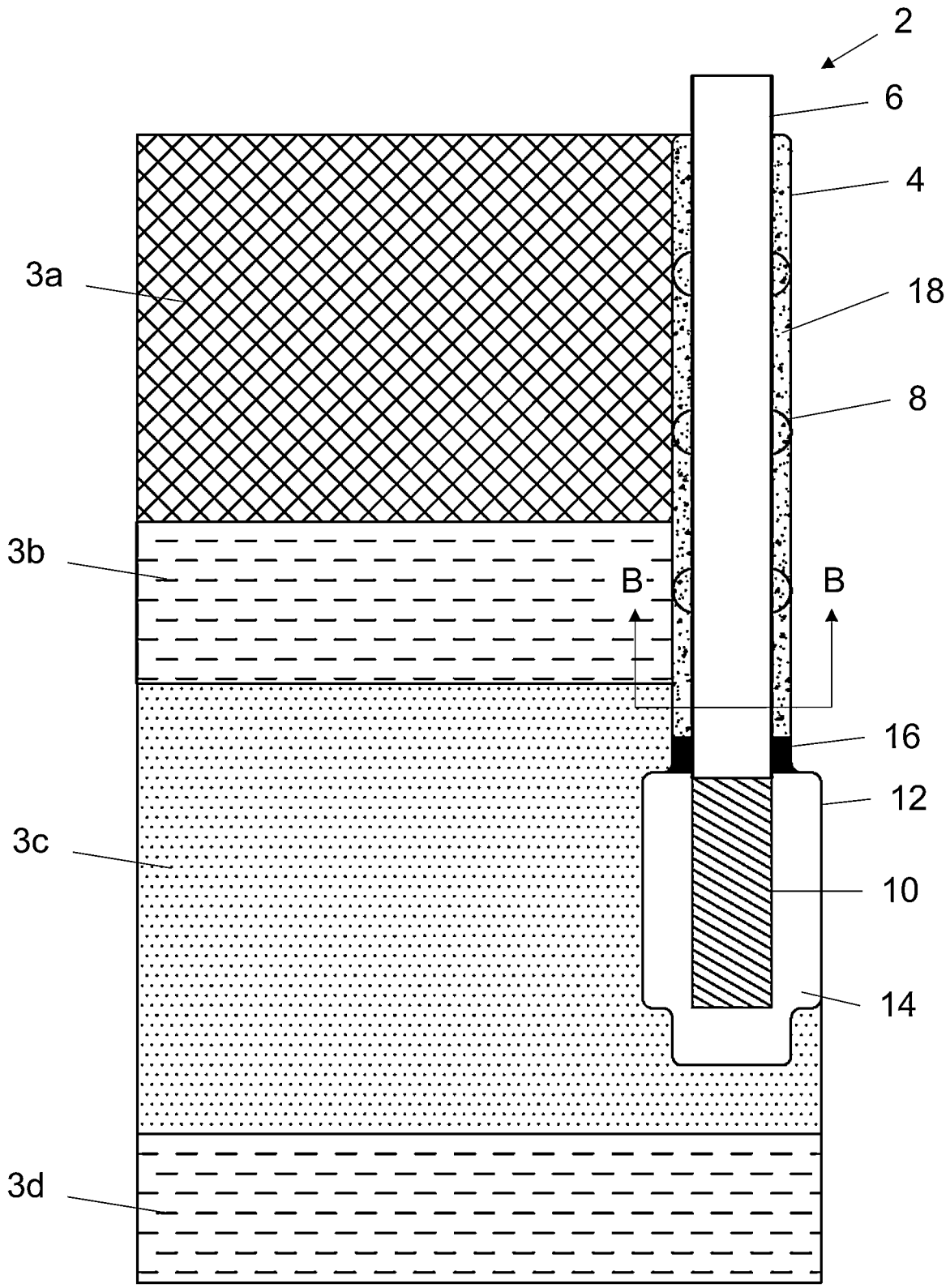
FIG. 1A is an elevation view of a well in accordance with embodiments of the present disclosure.

The drawings are not necessarily (but may be) to scale. In certain instances, details that are not necessary for an understanding of the disclosure or that render other details difficult to perceive may have been omitted. It should be understood, of course, that the disclosure is not necessarily limited to the embodiments illustrated herein. As will be appreciated, other embodiments are possible using, alone or in combination, one or more of the features set forth above or described below. For example, it is contemplated that various features and devices shown and/or described with respect to one embodiment may be combined with or substituted for features or devices of other embodiments regardless of whether or not such a combination or substitution is specifically shown or described herein.

Similar components and/or features may have the same reference label. Further, various components of the same type may be distinguished by following the reference label by a letter that distinguishes among the similar components. If only the first reference label is used, the description is applicable to any one of the similar components having the same first reference label irrespective of the second reference label.

The following is a listing of components according to various embodiments of the present disclosure, and as shown in the drawings:

| Number | Component |
|---|---|
| 2 | Well |
| 3a-3d | Geologic Formation |
| 4 | Wellbore |
| 6 | Thermoplastic Casing |
| 8 | Centralizer |
| 10 | Screen |
| 12 | Under-Reamed Portion |
| 14 | Gravel Pack |
| 16 | Impermeable Layer |
| 18 | Cement |
| 20 | Tremie Line |
| 22 | Well Diameter |
| 24 | Casing Diameter |
| 26 | Tremie Diameter |
| 28 | Conducting Pre-Installation Actions |
| 30 | Selectively Connecting Tremie Line |
| 32 | Lowering Casing and Tremie Line |
| 34 | Raising Casing and Tremie Line |
| 36 | Injecting Gravel Pack and Sand Cap (optional) |
| 38 | Injecting Cement |
| 40a, 40b | Injection Well |
| 40c, 40d | Injection Well |
| 40e, 40f | Injection Well |
| 42a, 42b | Production Well |
| 44a, 44b | Lixiviant Flow |
| 46 | Check Valve |
| 48 | Sand Trap |
| 50 | Screen |
| 52 | Under-Reamed Portion |
| 54 | Gravel Pack |
| 56 | Packer |
| 58 | Collar |
| 60 | Wellbore |
| 62 | Casing |
| 64 | Centralizer |
| 66 | Cement |
| 68 | Pump |
| 70 | Production Tubing |
| 72 | Header House |
| 74 | Flow Path |
| 76 | Poor Sweep Area |

DETAILED DESCRIPTION

The present disclosure has significant benefits across a broad spectrum of endeavors. It is the Applicant's intent that this specification and the claims appended hereto be accorded a breadth in keeping with the scope and spirit of the disclosure being disclosed despite what might appear to be limiting language imposed by the requirements of referring to the specific examples disclosed. To acquaint persons skilled in the pertinent arts most closely related to the present disclosure, a preferred embodiment that illustrates the best mode now contemplated for putting the disclosure into practice is described herein by, and with reference to, the annexed drawings that form a part of the specification. The exemplary embodiment is described in detail without attempting to describe all of the various forms and modifications in which the disclosure might be embodied. As such, the embodiments described herein are illustrative, and as will become apparent to those skilled in the arts, may be modified in numerous ways within the scope and spirit of the disclosure.

Although the following text sets forth a detailed description of numerous different embodiments of methods and systems for using thermoplastic casings, it should be understood that the detailed description is to be construed as exemplary only and does not describe every possible embodiment since describing every possible embodiment would be impractical, if not impossible. Numerous alternative embodiments can be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning.

Figure 1B:
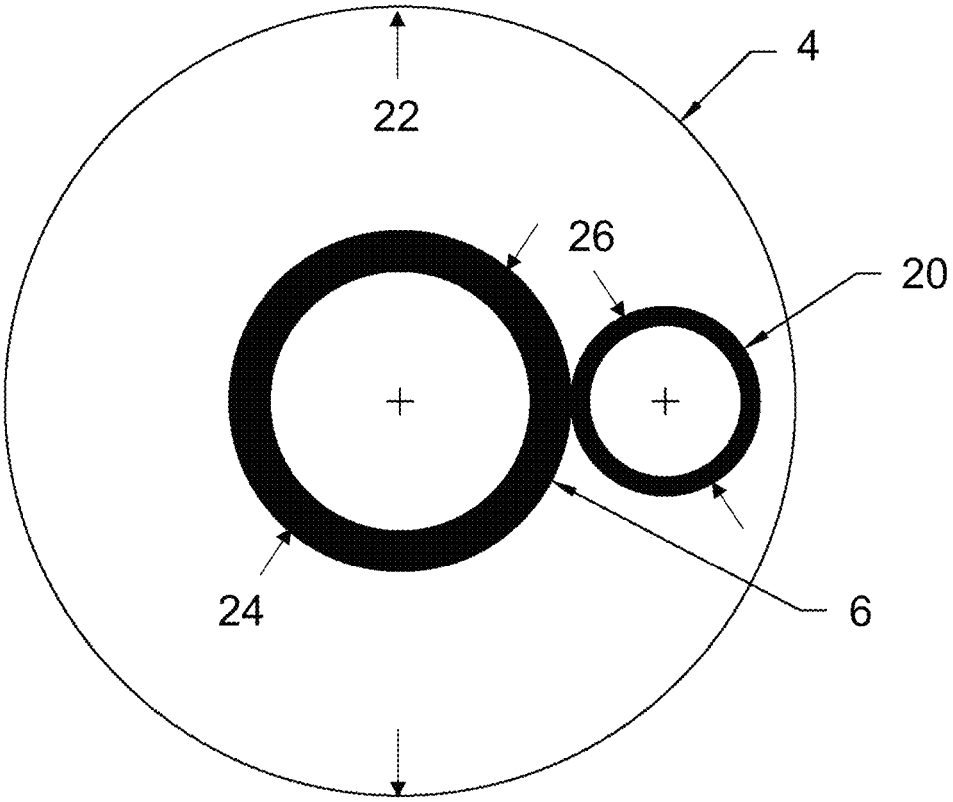
FIG. 1B is a cross-sectional view of the wellbore in FIG. 1A taken along line B-B with the tremie line still present, as in during installation, in accordance with embodiments of the present disclosure.

Referring now to FIGS. 1A and 1B, an elevation view of a well 2 with geologic formations 3*a*-3*d* and a cross-sectional view of part of the wellbore 4 are provided, respectively. FIG. 1A shows the well 2 after an installation process, and FIG. 1B shows the well 2 during the installation process with a tremie line (20 in FIG. 1B) still attached to a casing 6 or a screen 10. The wellbore 4 is initially drilled out, and then the casing 6 is deployed into the wellbore 4. As discussed herein, the casing 6 may be a continuous, thermoplastic material such as HDPE. Optionally, centralizers 8 are attached to the casing 6 to keep the casing 6 aligned and centered within the wellbore 4. The centralizers 8 may each have a slot or aperture to allow a tremie line 20 to pass through. The screen 10 is positioned at a lower or distal end of the casing 6, and the casing 6 is lowered within the wellbore 4 until the screen 10 reaches particular geologic formation 3*c*.

In some embodiments, the screen 10 is approximately 3 inches (76.2 mm) in cross-sectional diameter. In various embodiments, the screen 10 is between approximately 2 inches and 4 inches (50.8 mm and 101.6 mm). Further still, the screen 10 can be described as having a diameter that is between +/−10% of the diameter 24 of the casing 6 (described in conjunction with FIG. 1B). In some embodiments, the screen 10 has a diameter that is less than an inner diameter (22 in FIG. 1B) of the wellbore 4.

In some embodiments, the screen 10 is made of stainless steel, though it will be appreciated that the screen 10 may be made from other metals or even non-metals. In various embodiments, the screen 10 is plastic wire wrapped, slotted pipe, or stainless-steel wire wrapped. The screen 10 has an open area such as a plurality of holes or slots to permit fluid flow in contrast to a closed area, which is the physical structure of the screen 10. In some embodiments, the open area is between approximately 30 and 40% of the total area of the screen 10. In various embodiments, the open area is approximately 34% of the total area of the screen 10 to provide a fluid velocity through the screen 10 of approximately 0.07 feet/sec (21.3 mm/sec).

The screen 10 can have a length of approximately 18 feet (5.49 meters), or even between approximately 15 feet and 25 feet (4.57 meters to 7.62 meters) in various embodiments. Further still, the screen 10 can have a length between approximately 1 foot and 300 feet (0.3 meters to 91.5 meters) in some embodiments. The length of the screen 10 can depend on several factors including, for instance, the size and shape of the geologic formation 3*c* of interest.

At a predetermined depth within the particular geologic formation 3*c*, and typically prior to deployment of the casing 6, the wellbore 4 can be optionally under-reamed to increase the diameter of the wellbore 4 in the completion zone where the screen 10 is ultimately deployed. One objective of under-reaming is to clean drill mud and native clays from the face of the wellbore which may impede the flow of water or other fluids. Another objective is to increase the diameter of the completion zone to reduce friction losses and thereby increase flow rates.

In some embodiments, the diameter of the under-reamed portion is at least ½ inch (12.7 mm) larger than the diameter of the wellbore. In various embodiments, the diameter of the under-reamed portion is between 7 inches and 11 inches (177.8 mm and 279.4 mm). The under-reamed portion may then be packed in with gravel.

A tremie line (20 in FIG. 1B) can inject gravel 14 around the screen 10 and then inject cement 18 around the casing 6 as described in further detail herein. The tremie line can also be made from a continuous, thermoplastic material such as HDPE. Optionally, as shown in FIG. 1A, an impermeable layer 16 can be deposited in the wellbore 4 to separate the gravel 14 from the cement 18 and prevent the cement 18 from contaminating the gravel 14. The impermeable layer 16 can be a cap of fine sand. Optionally, a weight can be positioned on the lower or distal end of the casing 6 or screen 10 to help pull the casing down the wellbore 4.

Referring to FIG. 1B, a cross-sectional view of the wellbore 4 taken along line B-B in FIG. 1A is provided. Specifically, the wellbore 4, the casing 6, and the tremie line 20 are shown during an installation process. The diameters of these components are also depicted where the wellbore 4 has an inner diameter 22, the casing 6 has an outer diameter 24, and the tremie line 20 has an outer diameter 26. The relationship among these diameters 22, 24, 26 can be critical for the installation and use of the embodiments of the present disclosure. Moreover, the use of a continuous, thermoplastic casing 6 typically means a smaller diameter 24 is practical, yet certain regulatory, safety, and operational standards are maintained. The smaller diameter 24 is more environmental and cost effective, which allows for different arrangements of injection and production well as described herein.

With these considerations, in some embodiments, the casing diameter 24 is no more than 3 inches (76.2 mm). It will be appreciated that the casing diameter 24 can reflect any number of readily available thermoplastic tubing sizes. For instance, the casing diameter 24 can be ½ inch, 1 inch, 1.25 inches, 1.5 inches, 1.75 inches, 2.0 inches, 2.25 inches, 2.5 inches, 2.75 inches, or 3.0 inches (12.7 mm, 25.4 mm, 31.8 mm, 38.1 mm, 44.5 mm, 50.8 mm, 57.2 mm, 63.5 mm, 69.9 mm, or 76.2 mm, respectively).

In various embodiments, the wellbore diameter 22 is at least 3 inches (76.2 mm) greater than the casing diameter 24. In some embodiments, the tremie diameter 26 is less than the casing diameter 24. Thus, in the depicted embodiment, the wellbore diameter 22 is approximately 5.5 inches (139.7 mm). In some embodiments, the wellbore diameter 22 is between approximately 4.5 inches and 7.5 inches (114.3 mm and 190.5 mm). The casing diameter 24 is approximately 2.375 inches (60.3 mm). In some embodiments, the casing diameter 24 is between approximately 1 inch and 4 inches (25.4 mm and 101.6 mm). The tremie diameter 26 is approximately 1.315 inches (33.4 mm). In some embodiments, the tremie diameter 26 is between approximately 1 inch and 2 inches (25.4 mm and 50.8 mm).

The relationship between the diameters 22, 24, 26 can also be expressed in relative terms. For example, the tremie diameter 26 can be described as being between approximately 30% and 110% of the casing diameter 24. In some embodiments, the tremie diameter 26 is approximately 55% of the casing diameter 24. Further, the wellbore diameter 22 can be described as being between approximately 150% and 300% of the casing diameter 24. In some embodiments, the wellbore diameter 22 is approximately 230% of the casing diameter 24.

Figure 2:
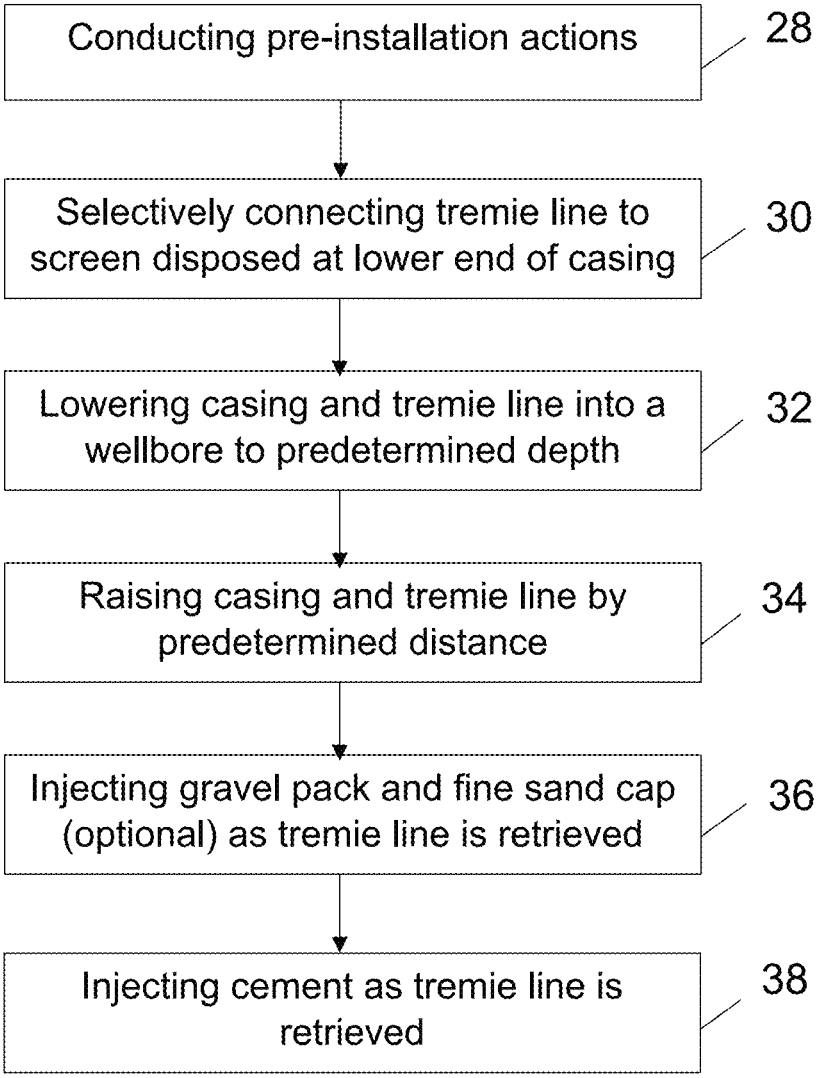
FIG. 2 is an exemplary method of installing a thermoplastic casing in a wellbore in accordance with one or more embodiments of the present disclosure.

Now referring to FIG. 2, an exemplary method of installing a casing into a wellbore is provided. First, all of the necessary supplies and components are provided, and any pre-installation actions 28 are taken. For instance, the wellbore is drilled, flushed, and under-reamed if necessary. Moreover, for example, trucks with coils of the continuous tubing that serve as the casing and trucks with gravel, cement, and/or water are provided. Multiple coils can be provided, for instance, a first coil for a casing and a second coil for a tremie line, where the coils may be the same or different materials with different sizes, as described herein. Other components may include a cement unit pulled by a water truck and/or a pulling unit. Then, a stainless-steel female socket is pressed into the lower or distal end of the casing, and a screen is connected to the socket on the casing.

Next, the lower or distal end of the tremie line is selectively connected 30 to the screen above a lower or distal end of the screen. Selectively connected can mean a temporary or semi-permanent connection such as tape or a harness, where subsequent movements or motions can separate the tremie line from the screen. In some embodiments, the offset between the bottom of the tremie line and the bottom of the screen is approximately 2 feet (0.61 meters). In some embodiments, the offset is between approximately 1 foot and 3 feet (0.3 meters to 0.92 meters).

Now, the casing, screen, and tremie line are lowered 32 into the wellbore. If there is resistance as the casing, screen, and tremie line are lowered, then these components can be removed from the wellbore, and the wellbore is flushed again to clear any obstructions. As these components are lowered into the wellbore, centralizers can be attached to the casing to keep the casing and components centered within the wellbore. In some embodiments, a first centralizer is connected to the casing at approximately 2 feet (0.61 meters) above the screen, a second centralizer is approximately 5 feet (1.52 meters) above the screen, and a third centralizer is approximately 10 feet (3.05 meters) above the screen. Then, centralizers can be spaced approximately 40 feet (12.2 meters) apart from each other. One centralizer can be 40 feet (12.2 meters) below the surface to allow space in the annulus between the casing and the wellbore to later reintroduce the tremie line and pour additional cement if there is fall back within the wellbore. A final centralizer can be located at the surface. It will be appreciated that any obstructions are cleared at any point during the installation. Once the screen is proximate to the geologic formation of interest and at the completion zone, the casing and tremie line can be raised 34 upward by a predetermined distance to straighten and centralize the casing within the wellbore.

Then, the gravel can optionally be injected 36 through the tremie line with water to surround the screen with gravel of the appropriate size and volume as determined by the geologist or drilling supervisor. The tremie line is slowly retracted as gravel is injected to break the selective connection between the tremie line and the screen so the tremie line is not packed in place with gravel. In some embodiments, the tremie line is retracted halfway up the screen as half of the total gravel is injected. It will be appreciated that the gravel pack may be optional in some embodiments depending on the stability of the wellbore.

In embodiments that include a gravel pack, once the gravel is injected, an impermeable layer such as a cap of fine sand can be placed in the wellbore to separate the gravel from the cement so that cement does not infiltrate the gravel pack and inhibit the injection flow. In some embodiments, approximately three gallons of fine sand are used. In some embodiments, the fine sand can be characterized as having particles no larger than 0.25 mm, or as having an average particle size that is no larger than 0.25 mm. This action, in various embodiments, may include the use of lost-circulation-material and/or a cement basket to minimize cement contamination of the injection zone.

Next, the casing is grouted in place. The cement can be mixed and then injected 38 via the tremie line, which by this point has been retracted to the lower end of the casing. The tremie line is retracted as cement is poured into the annulus between the casing and the wellbore. Once the cement is level with the surface, the tremie line can be flushed clean into the mud pit. After a period of time, more than 24 hours in some embodiments, the well can be inspected and any additional cement can be added to the annulus. The casing can also be cut at the surface, leaving a continuous casing with no joints between the surface and the screen, which reduces the likelihood of leaks and failures in the casing during operation.

If the pressure rating of the casing may be exceeded while cementing or grouting the annulus, the external pressure can be counteracted by pressurizing the inside of the casing. One method is to seal the bottom of the casing with a glass disc or check valve. The casing can then be pressurized with water and/or gas to offset the pressure generated by the cement or grout in the annulus. Once the cement or grout has cured, the solid material in the annulus surrounding the casing dramatically increases the collapse strength and the pressure is relieved. If a glass disc is used, it can be removed by breaking it with a heavy pointed bar. A further consideration is the heat of hydration of cement, which can soften the casing and reduce the collapse pressure rating of the casing. The casing may be optionally cooled and/or pressurized until the cement is cured.

After grouting, subsequent actions can be performed to the well. For instance, the well can be developed using pumping, swabbing, airlifting, jetting, and chemical methods such as clay dispersants and/or acids. These development actions can enhance the gravel in the wellbore and remove clay to optimize the injection rate. Uncontaminated water can flow to the mud pit while contaminated water is captured by a wastewater management system. Pumps are optionally used as the diameter of the casing can be too narrow in some embodiments.

Since the casing is a continuous, thermoplastic casing, a pressure relief valve and attendant fitting can be teed in place rather than any crossover fittings. Mechanical Integrity Testing (MIT) procedures can remain the same for a continuous, thermoplastic casing, and well abandonment can utilize the tremie and grout method.

After installation, it will be appreciated that the well may be an injection well in some embodiments where fluid is driven through the well and into a geologic formation to stimulate the formation and extract resources such as oil, gas, or ore. Other embodiments of the present disclosure encompass other types of wells such as production wells. Moreover, it will be appreciated that swabbing functions and other functions can be performed in the wells described herein. In addition, jetting, air lifting, and chemical treatments can also be performed. Disinfection may be carried out by the injection of oxygen or hydrogen peroxide or other disinfectants during operations.

Figure 3A:
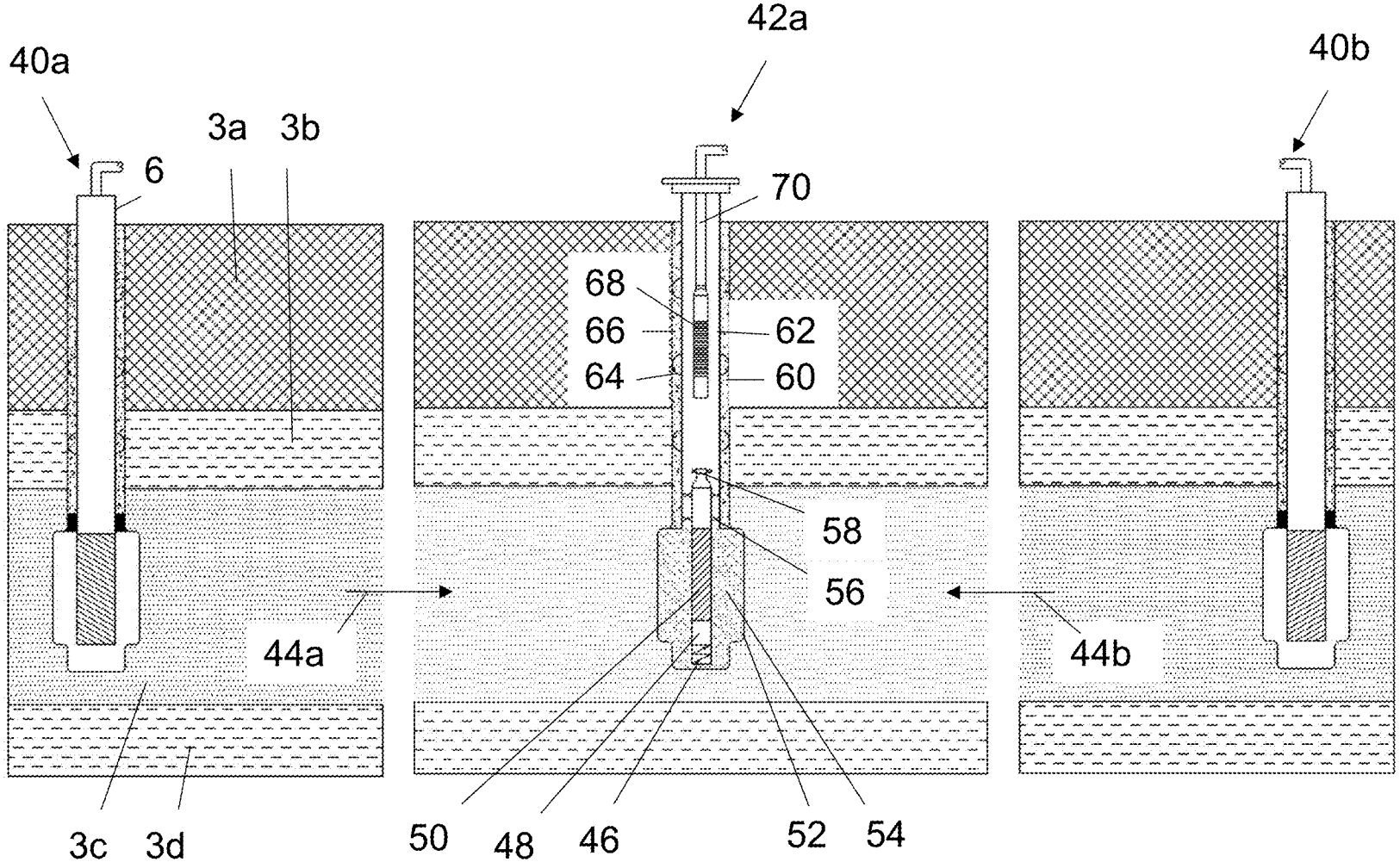
FIG. 3A is an elevation view of injection wells and a production well in accordance with at least one embodiment of the present disclosure.
Figure 3B:
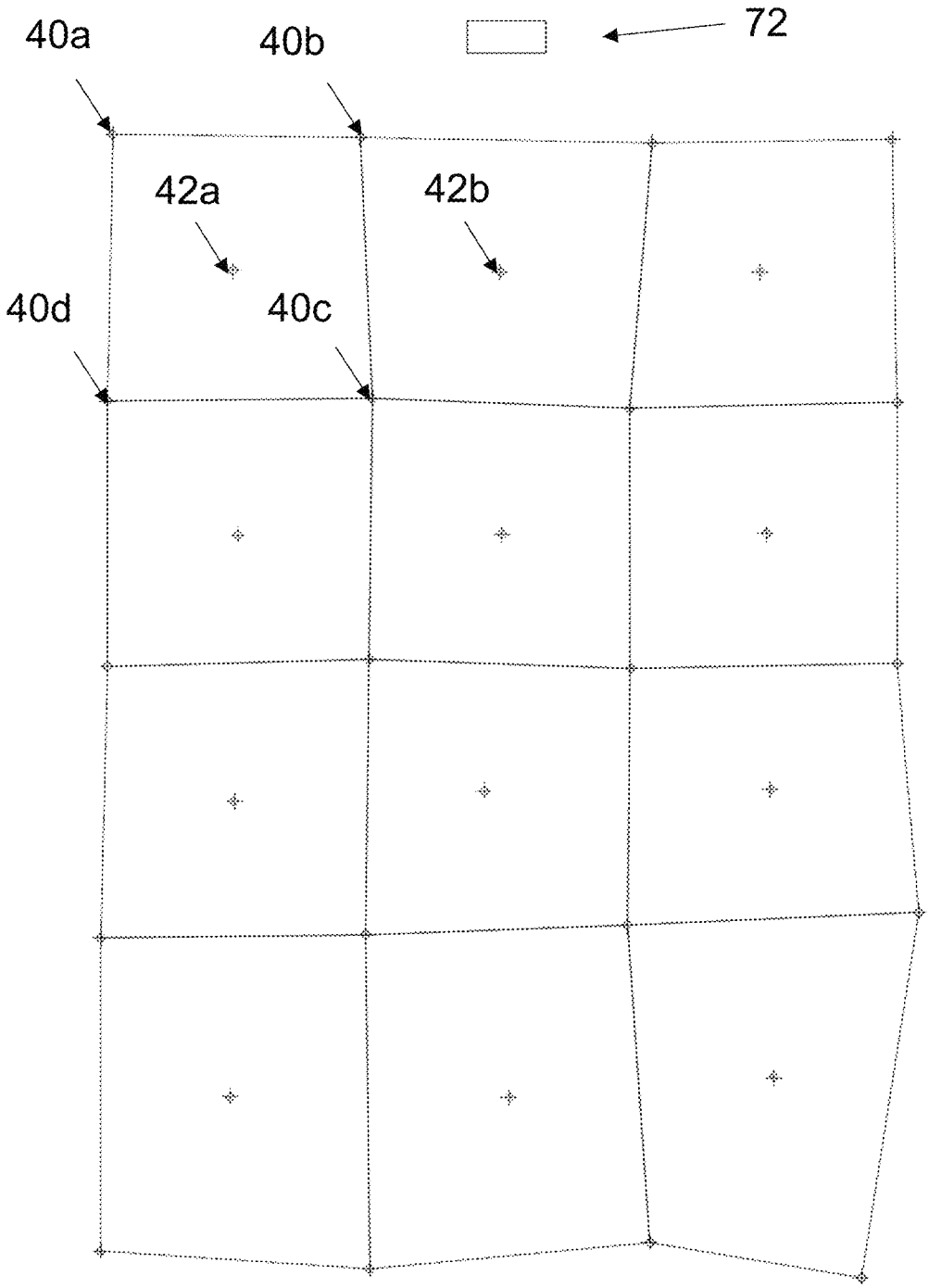
FIG. 3B is a top plan view of injection wells and production wells in accordance with embodiments of the present disclosure.

FIGS. 3A and 3B show an elevation view and a top plan view, respectively, of injection and production wells. FIG. 3A shows injections wells 40*a*, 40*b* on either side of a production well 42*a*. With completed injection wells 40*a*, 40*b* that include a continuous, thermoplastic tubing as a casing 6, a fluid such as a lixiviant 44*a*, 44*b* is injected into the respective injection wells 40*a*, 40*b*. The lixiviant 44*a*, 44*b* flows through the respective casings and out of the respective screens and into the surrounding geologic formations 3*c*. Here, the lixiviant 44*a*, 44*b* can leach and/or dissolve particular metal ores such as uranium. Then, the lixiviant 44*a*, 44*b* flows through the production well 42*a* and to the surface. Then ore-enriched lixiviant 44*a*, 44*b* is processed to extract the metal ore.

The production well 42*a* optionally has at least one check valve 46 and a sand trap 48 in the wellbore 60 below a screen 50. The screen 50 is located in an under-reamed portion 52 of the wellbore 60, and a gravel pack 54 surrounds the screen 50. During installation, the screen 50 can be lowered into position within a casing 62. Then, one or more pliable packers 56 between the casing 62 and the collar 58, to which the screen 50 is attached, separate the gravel packed volume around the screen 50 from the interior of the casing 62.

The casing 62 of the production well 42*a* can be similar to the casing 6 of the injection well 40*a* where the casing 62 is a continuous, non-jointed, thermoplastic tubing that is deployed down the wellbore 60 in the same or similar manner as the casing 6 of the injection well 40*a*. Alternatively, the casing 62 of the production well 42*a* is made from multiple segments of pipe joined together, from fused pipe, etc. Moreover, the casing 62 may include one or more centralizers 64 and is cemented 66 in place within the wellbore 60. A pump 68 is positioned within the casing 62 to draw a combination of the lixiviant and ore out of the geologic formation 3*c*, through the screen 50, through the collar 58, into a production tubing 70, and out of the production well 42*a* where the ore is separated and then used in a variety of subsequent processes and/or applications. In some embodiments, the diameter of the casing 62 of the production well 42*a* is greater than the diameter of the casing 6 of the injection well 40*a* to accommodate the pump 68.

FIG. 3B is a top plan view of injection wells 40*a*-40*d* and production wells 42*a*, 42*b* in a grid-like pattern. The injection wells 40*a*-40*d* are located at the intersections of the grid lines, and production wells 42*a*, 42*b* are located at (or near) the center of the grids such that a given production well 42*a* is surrounded by four injections wells 40*a*-40*d*. As shown in FIG. 3B, the distance between two injection wells 40*a*-40*d* on a grid line is not always consistent due to the topography of the earth in the particular area, or other considerations. With this arrangement, as lixiviant fluid is deployed into the injection wells 40*a*-40*d* and into the particular geologic formation, the lixiviant fluid spreads away from each injection wells 40*a*-40*d* in a radial direction until it reaches a production well 42*a*. Thus, the production well 42*a* receives lixiviant fluid from four surrounding injection wells 40*a*-40*d* in an efficient arrangement. Also shown in FIG. 3B is a header house 72 that coordinates the flow of fluids to and from the injection and production wells.

Figure 4C:
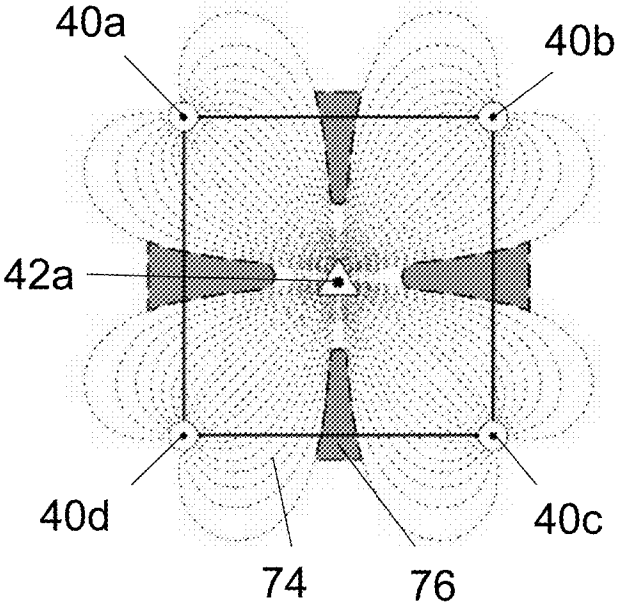
FIG. 4C is a top plan view of the injection wells and the production well in FIG. 4A at a third operation time in accordance with embodiments of the present disclosure.
Figure 4B:
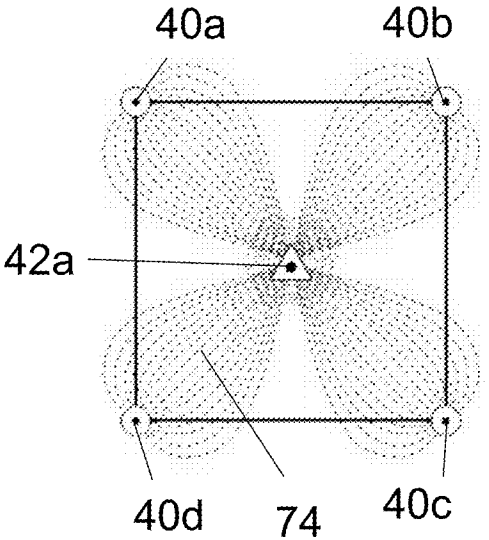
FIG. 4B is a top plan view of the injection wells and the production well in FIG. 4A at a second operation time in accordance with embodiments of the present disclosure.
Figure 4A:
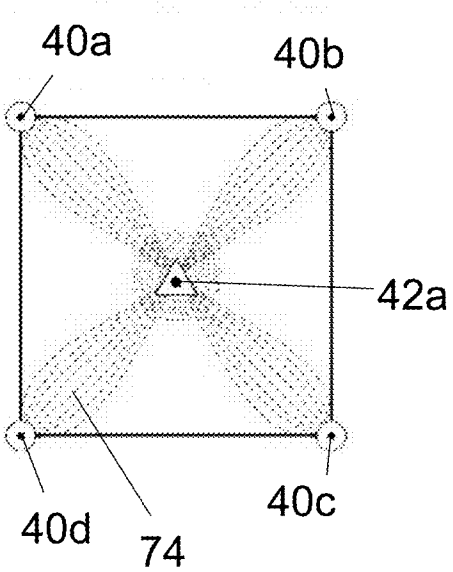
FIG. 4A is a top plan view of injection wells and a production well at a first operation time in accordance with embodiments of the present disclosure.

FIGS. 4A-4C are top plan views of four injection wells 40*a*-40*d* surrounding a production well 42*a* to further illustrate this principle. These figures show the flow pattern of lixiviant from the injection wells 40*a*-40*d* to the production well 42*a* over time where FIG. 4A shows the flow pattern at a first time, FIG. 4B shows the flow pattern at a second time, and FIG. 4C shows the flow pattern at a third time.

The injection wells 40*a*-40*d* are located at the intersection of gridlines, and the production well 42*a* is disposed therebetween, typically at approximately the center of a grid. The lixiviant fluid travels from the injection wells 40*a*-40*d* to the production well 42*a* along a flow path 74. As time progresses and the geologic formation becomes saturated with lixiviant fluid, the flow path 74 broadens. However, with the gridlike arrangement of wells, there is still an inefficient area 76 between injection wells 40*a*-40*d* that does not carry the lixiviant fluid, including the desired ore, to the production well 42*a*. This inefficient area 76 persists even at a later, third time as shown in FIG. 4C.

Figure 5C:
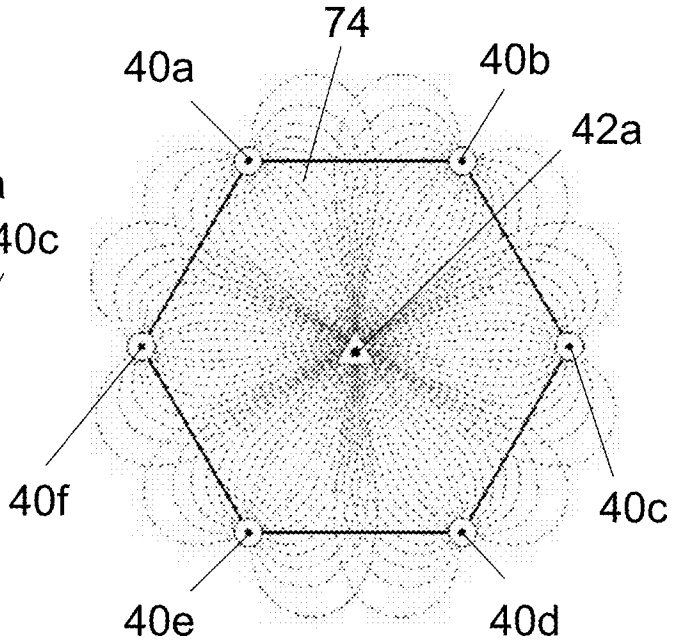
FIG. 5C is a top plan view of the injection wells and the production well in FIG. 5A at a third operation time in accordance with embodiments of the present disclosure.
Figure 5B:
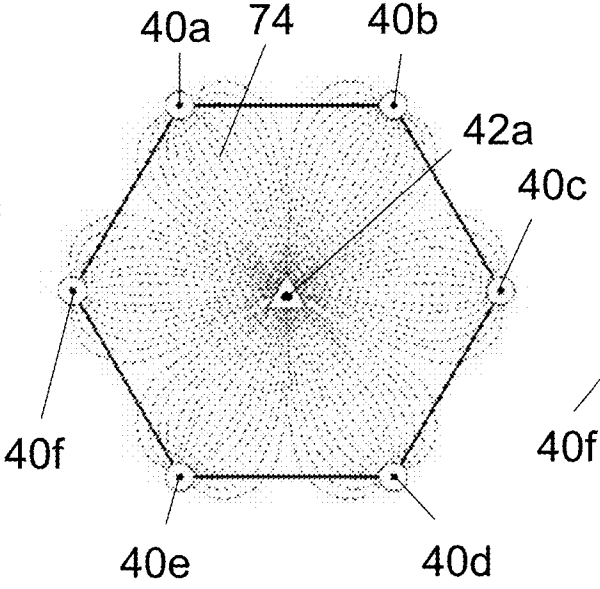
FIG. 5B is a top plan view of the injection wells and the production well in FIG. 5A at a second operation time in accordance with embodiments of the present disclosure.
Figure 5A:
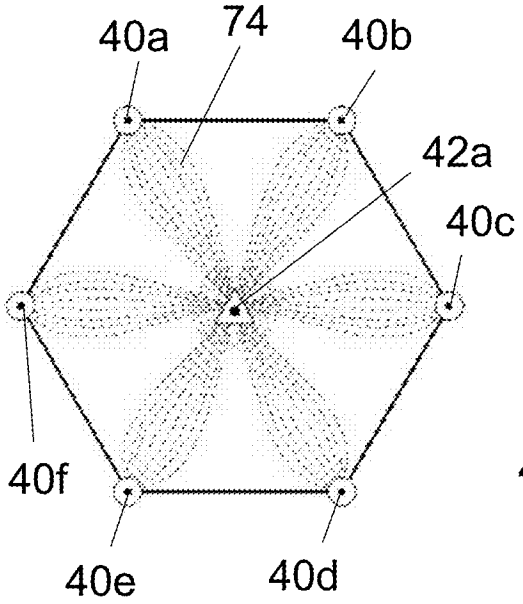
FIG. 5A is a top plan view of further injection wells and a production well at a first operation time in accordance with embodiments of the present disclosure.

FIGS. 5A-5C are top plan views of six injection wells 40*a*-40*f* surrounding a production well 42*a*. These figures show the flow pattern of lixiviant from the injection wells 40*a*-40*f* to the production well 42*a* over time where FIG. 5A shows the flow pattern at a first time, FIG. 5B shows the flow pattern at a second time, and FIG. 5C shows the flow pattern at a third time. In this arrangement, the injection wells 40*a*-40*f* are located at the corners of a hexagonal shape (seven-spot geometry), and the production well 42*a* is located therebetween, particularly at approximately the center of the hexagonal shape. Here, due to the hexagonal shape, over time the lixiviant fluid completely saturates the geologic formation around the production well 42*a* without any inefficient areas between injection wells 40*a*-40*f* This geometry increases the sweep efficiency, improves the percentage of uranium or other resource recovered, and shortens the time required for mining and groundwater restoration.

In addition, this arrangement balances the well geometry and spacing against economics for the most cost-effective way to utilize embodiments of the present disclosure. Specifically, with the environmental and cost benefits from using a continuous, non-jointed, thermoplastic tubing as a casing for one or more injection wells 40*a*-40*f*, the need or inclination to minimize the number of injection wells 40*a*-40*f* is eliminated or reduced, and a more efficient, hexagonal arrangement of injection wells 40*a*-40*f* can be pursued to eliminate inefficient sweep areas. It will be appreciated that embodiments of the present disclosure encompass other arrangements of injection and production wells.

One particular technical analysis of a casing that is a continuous, non-jointed, thermoplastic tubing is provided herein. This is an analysis for an exemplary embodiment of the present disclosure for the Lost Creek Project in Wyoming, but embodiments of the present disclosure encompass further technical analyses. The engineering specifications for this particular technical analysis are generally taken from two sources: WL Plastics Engineering web page at https://wlplastics.com/documents/engineering-info/ which is incorporated herein in its entirety by reference, and Plastic Pipe Institute (PPI) web page at https://plasticpipe.org/PPI- Home/PPI-Home/PPI-Home/Default.aspx?hkey=f1a534e6-efdc-41e5-bc7d-90625fc4c67b which is incorporated herein in its entirety by reference.

The internal pressure rating of a coiled HDPE casing is made in reference to the Plastic Pipe Institute (PPI), Design of PE Piping Systems, which is incorporated herein in its entirety by reference, Chapter 3, App. A, Table A-1, Hydrostatic Design Stress, HDS at 73° F. (22.8° C.) for PE4710 (HDPE)=1,000 psi (6.89 MPa). This is used to calculate the internal pressure rating using the formula: Internal Pressure Rating=Hydrostatic Design Stress (HDS)×2/(Standard Dimensionless Ratio (SDR) 1)

| SDR | Pressure Rating at 73° F. (22.8° C.) |
|---|---|
| 11 | 200 psi (1.38 MPa) |
| 9 | 250 psi (1.72 (MPa) |
| 7 | 320 psi (2.21 MPa) |

Further, from Plastic Pipe Institute (PPI), Design of PE Piping Systems, Chapter 3, App. A, Table A-2, Temperature Compensating Multipliers for Converting a Base Temperature HDS or Pressure Rating (PR) to HDS or PR for another Temperature Between and 40 and 100° F. (4.4 to 37.8° C.).

| Max Sustained Temp ° F. | Multiplier |
|---|---|
| 40 (4.4° C.) | 1.25 |
| 50 (10° C.) | 1.17 |
| 60 (15.6° C.) | 1.10 |
| 73 (22.8° C.) | 1.00 |
| 80 (26.7° C.) | 0.94 |
| 90 (32.2° C.) | 0.86 |
| 100 (37.8° C.) | 0.78 |

In the case of normal operations at, for example, the Lost Creek Project, flowing and groundwater temperatures are typically 56° F. (13.3° C.). Interpolating values from the table above, at 56° F. (13.3° C.), the pressure rating multiplier is 1.128, resulting in the following table:

| SDR | Pressure Rating at 56° F. (13.3° C.) |
|---|---|
| 11 | 226 psi (1.56 MPa) |
| 9 | 282 psi (1.94 MPa) |
| 7 | 361 psi (2.49 MPa) |

The maximum internal pressure (IP) or injection pressure will be governed by the fracture pressure, which is in turn governed by the regional fracture gradient, or 0.7 psi/ft (15.8 KPa/m) plus a safety factor of 90%.

Internal Pressure=Depth to Injection Zone×(Fracture Gradient−Water Gradient)×SafetyFactor IP=700 ft×(0.7 psi/ft.−0.433 psi/ft)×0.9

IP=168 psi (1.12 MPa) which is less than the burst pressure of SDR-7 HDPE (361 psi (2.49 MPa)), SDR-9 HDPE (282 psi (1.94 MPa)), or SDR-11 HDPE (226 psi (1.56 MPa)).

In addition, the manufacturer of the tubing used for the casing includes a safety factor of 2 to account for operational variabilities such as water hammer and cyclic pressurizing, neither of which are applicable in this technical analysis. Therefore, the proposed operating pressure is well within the acceptable range of this class of pipe.

For external pressure rating, the maximum pressure on the outside of the HDPE casing occurs during the cementing of the casing. This is, in effect, a short-term stress or pressure event on the ability of the casing to withstand an external pressure event. This is because the difference in hydraulic head between the cement weight and the water weight only occurs until the cement is set, which is generally accepted as 24 hours or less. After that time, the cement then becomes a self-supporting structural solid that is no longer exerting force on the casing. Instead, the cured cement works to support the structure of the HDPE pipe or casing.

From Plastic Pipe Institute (PPI), Design of PE Piping Systems, Chapter 3, App. C, Table C-1, Allowable Compressive Stress, at 73° F. (22.8° C.) for PE4710=1,150 psi (7.93 MPa). The allowable unconstrained pipe collapse calculation (from the manufacturer) is then utilized to determine allowable depths of casing for each pipe/casing rating:

$$S_c=(D_{csg})(\rho)DR)/(SF)$$

$S_c$=Allowable Compressive Stress for PE4710 HDPE pipe, =1,150 psi (7.93 MPa)

$D_{csg}$=Depth of casing, ft.

ρ=Net density of fluid exerting outside pressure on the pipe, lb/gal=ρ cmt−ρ water ρ cmt=Density of cement used to cement casing in the annular space=15 lb/gal (1.79 kg/L)

ρ water=Density of water inside the casing=8.33 lb/gal (0.99 kg/L)

DR=(SDR) Dimension Ratio of the pipe, dimensionless=OD/t

SF=Safety Factor, dimensionless=2

Solving for Depth of casing, $D_{csg}$ in terms of the pipe Dimension Ratio, allows for the acceptable depths of casing for each scenario:

$$D_{csg}=(S_c)(SF)/[(\rho)(DR)]$$

$$D_{csg}=(S_c)(SF)/[(\rho_{cmt}-\rho_{water})(DR)]$$

$$D_{csg}=[(1{,}150\text{ psi})(2)(19.3)]/[(15\text{ lb/gal}-8.33\text{ lb/gal})(DR)]$$, where 19.3 converts to consistent units $$D_{csg}=6{,}655.2/DR$$

| Pipe DR (feet) | Allowable Casing Depth (feet) |
|---|---|
| 7 (2.1 m) | 950 (289.6 m) |
| 9 (2.7 m) | 739 (225.2 m) |
| 11 (3.4 m) | 605 (184.4 m) |

The maximum anticipated depth of casing at, for example, the Lost Creek Project is, conservatively, 700 feet (213.4 m). Therefore, SDR-7 and 9 pipe will be acceptable for all casing installations, using a safety factor of 2. SDR-11 pipe will be acceptable at depths less than 605 feet (184.4 m) deep.

For friction loss, assuming the worst-case scenario in which the smallest diameter HDPE tubing used is 2" (50.8 mm) PE4710 DR9 250 psi (1.72 MPa) rating with an internal diameter of 1.816" (46.1 mm) and 480 feet (146.3 m) long and a generous flowrate of 25 gpm (94.6 lpm), the friction loss will be about 4.9 psi (33.8 kPa) using the Hazen Williams Equation. This pressure loss is acceptable since it will have minimal impact on flow rates. The more realistic flow rate scenario using this very small diameter pipe is 15 gpm (56.8 lpm), which results in a pressure loss of only 1.9 psi (13.1 kPa) using the same calculation method.

For chemical compatibility, HDPE has historically been used throughout the in-situ industry to transport injection and production fluids containing oxygen, hydrogen peroxide, carbon dioxide, sodium chloride, and sodium bicarbonate. To date, there is no known evidence of failure or degradation due to chemical corrosion. A review of chemical compatibility tables confirms that HDPE is chemically resistant to water, carbon dioxide, sodium bicarbonate, sodium chloride, oxygen, and hydrogen peroxide. See Plastic Pipe Institute Technical Report 19, Chemical Resistance of Plastic Piping Materials, released 2020, which is incorporated herein in its entirety by reference.

For abrasion resistance, the abrasion resistance of HDPE is the best of any commonly used pressure piping, including PVC.

For thermal expansion, the thermal expansion of HDPE is approximately three times higher than for PVC. Thermal expansion can be an issue in applications where HDPE pipe is not adequately supported and there are wide fluctuations in temperature. A review of soil thermal gradients from numerous sources shows that seasonal temperature variation becomes less than 2° F. (−16.7° C.) within 10 to 15 meters of the surface. Even during the extreme temperatures of winter and summer, the temperature of the injection fluid at, for example, the Lost Creek Project, which is groundwater circulated through the processing plant, remains within a few degrees of ambient groundwater. So, thermal expansion is not a concern at depths exceeding about 10 to 15 meters (33 to 50 feet).

Cyclical seasonal thermal expansion and contraction near the surface may result in the HDPE casing separating from the cement and creating a micro annulus. The separation is expected to be minimal and of no operational consequence. The soil around the wellhead will be mounded to ensure any potential sources of contamination drain away and do not have an opportunity to enter the annulus.

For joints, the HDPE will be installed in continuous rolls with no butted/welded joints. This provides a significant benefit by eliminating a possible source of well failure.

For rapid crack propagation (RCP), RCP for PE4710 HDPE is >174 psi (1.2 MPa) at 32° F. (0° C.), but for PVC it is <29 psi (0.19 MPa) at the same temperature.

For water hammer resistance, the water hammer resistance or pressure surge resistance of HDPE is up to 100% while for PVC it is less than or equal to 60%.

For cyclic surge resistance, the cyclic surge resistance for PE 4710 HDPE is 250 million cycles while for PVC it is only 1 millioncycles.

For brittleness temperature, the brittleness temperature for PE4710 HDPE is <−103° F. (−75° C.) using the ASTM D746 test method, which is incorporated herein in its entirety by reference. By comparison, PVC is "brittle" for all operating temperatures less than 170° F. (76.7° C.).

For impact resistance, the impact resistance of PE4710 HDPE is >20 ft-lb/in$^2$ (42 kJ/m$^2$) using the ASTM D256 test method, which is incorporated herein in its entirety by reference. By comparison, the impact resistance of PVC, using the same test method, is <0.65 ft-lb/in$^2$ (1.37 kJ/m$^2$).

For ring deflection, the ring deflection for PE4710 HDPE is up to 100% while for PVC it is only up to 40%.

For tensile strength and/or axial loading, the tensile strength of PE4710 HDPE is 3,500 to 4,000 psi (24.1 to 27.6 MPa). The smallest pipe considered for use in this embodiment is 2" (50.8 mm) DR11 which has a cross sectional area of 1.54 in$^2$ (993.5 mm$^2$). The same pipe has a weight of 0.634 lbs/ft (0.63 kg/m). In this example, at the extreme case of a 1,000 foot (304.8 m) deep well with 20 feet (6.1 m) of 3" (76.2 mm) stainless steel screen that weights 4.4 lbs/ft (6.55 kg/m) hanging on the HDPE, the entire downhole assembly would weigh (1,000 ft of HDPE×0.634 lbs/ft)+(20 ft screen×4.4 lbs/ft)=722 lbs (327.5 kg). The minimum tensile strength of the pipe, with a 2× safety factor, is 3,500 psi×1.54 in$^2$=5,390 lbs (2,444.9 kg). Therefore, even the smallest diameter pipe with the thinnest wall anticipated for use has a tensile strength far exceeding even the worst-case scenario (5,390 lbs (2,444.9 kg) rating vs 722 lbs (327.5 kg) actual load). This conservative calculation does not account for the buoyancy of HDPE in water or cement which makes it even more conservative.

To provide additional background, context, and to further satisfy the written description requirements of 35 U.S.C. § 112, the following references are incorporated by reference herein in their entireties: Wyoming Land Quality Division (LQD) Chapter 11, Section 8 "Well Construction Requirements"; LQD Guideline 4, Reference Document 8, Section I(C)(1); Section 3.3 of the Operations Plan, Lost Creek ISR, LLC's Lost Creek In Situ Uranium Mine Permit to Mine Application, as amended, approved by the Wyoming Land Quality Division on Oct. 21, 2011; Wyoming Uranium Recovery Program (URP) Rules and Regulations Chapters 1 through 9; Wyoming Water Quality Division (WQD) Rules and Regulations Chapters 12 and 26; ASTM Standard F480; Nuclear Regulatory Commission (NRC) NUREG 1569, NRC NUREG 1910, NRC NUREG 1910 Supplement 3 for Lost Creek; Lost Creek NRC Technical Report; Lost Creek NRC Environmental Report; and NRC Safety Evaluation Report (SER) and License for Lost Creek, Docket 40-9068.

The description of the present disclosure has been presented for purposes of illustration and description, but is not intended to be exhaustive or limiting of the disclosure to the form disclosed. Many modifications and variations will be apparent to those of ordinary skill in the art. The embodiments described and shown in the figures were chosen and described in order to best explain the principles of the disclosure, the practical application, and to enable those of ordinary skill in the art to understand the disclosure.

While various embodiments of the present disclosure have been described in detail, it is apparent that modifications and alterations of those embodiments will occur to those skilled in the art. Moreover, references made herein to "the present disclosure" or aspects thereof should be understood to mean certain embodiments of the present disclosure and should not necessarily be construed as limiting all embodiments to a particular description. It is to be expressly understood that such modifications and alterations are within the scope and spirit of the present disclosure, as set forth in the following claims.

What is claimed is:

1. A method of installing and using a casing composed of a continuous, non-jointed, thermoplastic tubing in a wellbore, comprising:

uncoiling, by a deployment tool, a tubing and lowering the tubing and a tremie line into the wellbore until a screen at a lower end of the tubing reaches a predetermined depth;

raising, by the deployment tool, the tubing and the tremie line by a predetermined distance to straighten and centralize the tubing within the wellbore;

injecting gravel through the tremie line to surround the screen with gravel as the tremie line is retrieved from the wellbore;

injecting cement through the tremie line to fill an annular space between the tubing and the wellbore as the tremie line is further retrieved from the wellbore;

removing, by the deployment tool, the tremie line from the wellbore and cutting the tubing leaving the casing without joints from a surface of the wellbore to the screen; and injecting a lixiviant fluid into the tubing where the lixiviant fluid travels through the screen and into a geologic formation where the lixiviant fluid interacts with uranium ore to produce a uranium-enriched lixiviant fluid.

2. The method of claim 1, further comprising selectively connecting the tremie line to the screen prior to lowering the tubing and the tremie line into the wellbore, wherein the selective connection between the tremie line and the screen is offset from a lower end of the screen by between 1 foot and 3 feet.

3. The method of claim 1, further comprising sealing the lower end of the tubing and introducing a fluid into an interior volume of the tubing to increase a pressure required to collapse the tubing during injection of cement into the annular space.

4. The method of claim 1, further comprising drilling the wellbore, wherein an inner diameter of the wellbore is between 150% and 300% of an outer diameter of the casing.

5. The method of claim 1, further comprising depositing an impermeable layer through the tremie line between the gravel and the cement.

6. The method of claim 5, wherein the impermeable layer is a sand material with an average particle size of no more than 0.25 mm.

7. The method of claim 1, further comprising attaching a plurality of centralizers to the tubing as the tubing and the tremie line are lowered into the wellbore, wherein a lowest centralizer of the plurality of centralizers is offset from the screen by approximately 2 feet, and wherein two centralizers of the plurality of centralizers are offset from each other by approximately 40 feet.

8. The method of claim 7, wherein each centralizer of the plurality of centralizers has an aperture through which the tremie line is drawn, leaving the centralizer encased in cement.

9. The method of claim 1, further comprising under-reaming a portion of the wellbore at the predetermined depth.

10. The method of claim 1, wherein the tubing is made from one of polyethylene (PE), polyvinyl chloride (PVC), polypropylene (PP), polyvinylidene fluoride (PVDF), thermoplastic elastomer (TPE), Tygon®, Nylon, polytetrafluoroethylene (PTFE), or polyurethane.

11. The method of claim 1, wherein an outer diameter of the tremie line is between 30% and 110% of an outer diameter of the casing.

12. The method of claim 1, wherein an inner diameter of the wellbore is between 150% and 300% of an outer diameter of the casing.

13. The method of claim 1, wherein the deployment tool comprises a truck with a coil of the tubing.

14. The method of claim 1, further comprising retrieving the tremie line along an entire length of the tubing to an upper end of the tubing.

* * * * *